US008205688B2

(12) United States Patent
Hall et al.

(10) Patent No.: US 8,205,688 B2
(45) Date of Patent: Jun. 26, 2012

(54) LEAD THE BIT ROTARY STEERABLE SYSTEM

(76) Inventors: David R. Hall, Provo, UT (US); David Wahlquist, Spanish Fork, UT (US)

( * ) Notice: Subject to any disclaimer, the term of this patent is extended or adjusted under 35 U.S.C. 154(b) by 380 days.

(21) Appl. No.: 12/491,149

(22) Filed: Jun. 24, 2009

(65) Prior Publication Data

US 2009/0255733 A1 Oct. 15, 2009

Related U.S. Application Data

(63) Continuation-in-part of application No. 12/362,661, filed on Jan. 30, 2009, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, which is a continuation-in-part of application No. 11/278,935, filed on Apr. 6, 2006, now Pat. No. 7,426,968, which is a continuation-in-part of application No. 11/277,380, filed on Mar. 24, 2006, now Pat. No. 7,337,858, which is a continuation-in-part of application No. 11/277,294, filed on Mar. 23, 2006, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 7/04* (2006.01)

(52) U.S. Cl. ..... 175/73; 175/107

(58) Field of Classification Search ..... 175/73, 175/107

See application file for complete search history.

(56) References Cited

U.S. PATENT DOCUMENTS

| | | | |
|---|---|---|---|
| 616,118 | A | 12/1889 | Kunhe |
| 465,103 | A | 12/1891 | Wegner |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |

(Continued)

*Primary Examiner* — Hoang Dang

(74) *Attorney, Agent, or Firm* — Philip W. Townsend, III

(57) ABSTRACT

In one aspect of the invention a tool string steerable system has a drill bit body with a working face. An indenter protrudes from the working face and the indenter is rotational fixed to a tool string component above the drill bit body. The indenter is rotationally isolated from the drill bit body.

17 Claims, 9 Drawing Sheets

U.S. PATENT DOCUMENTS 1,372,257 A * 3/1921 Swisher ..... 175/381
1,387,733 A 8/1921 Midgett
1,460,671 A 7/1923 Hebsacker
1,544,757 A 7/1925 Hufford
2,169,223 A 8/1931 Christian
1,821,474 A 9/1931 Mercer
1,879,177 A 9/1932 Gault
2,022,101 A * 11/1935 Wright ..... 175/293
2,054,255 A * 9/1936 Howard ..... 175/298
2,064,255 A 12/1936 Garfield
2,218,130 A 10/1940 Court
2,320,136 A 5/1943 Kammerer
2,345,024 A * 3/1944 Bannister ..... 173/31
2,466,991 A 4/1949 Kammerer
2,540,464 A 2/1951 Stokes
2,544,036 A 3/1951 Kammerer
2,725,215 A * 11/1955 Macneir ..... 175/298
2,755,071 A 7/1956 Kammerer
2,776,819 A 1/1957 Brown
2,819,041 A * 1/1958 Beckham ..... 175/93
2,819,043 A 1/1958 Henderson
2,838,284 A 6/1958 Austin
2,873,093 A * 2/1959 Hildebrandt et al. ..... 175/92
2,877,984 A * 3/1959 Causey ..... 175/106
2,894,722 A 7/1959 Buttolph
2,901,223 A 8/1959 Scott
2,963,102 A 12/1960 Smith
3,077,936 A * 2/1963 Arutunoff ..... 175/101
3,135,341 A 6/1964 Ritter
3,139,147 A * 6/1964 Hays et al. ..... 175/233
3,294,186 A 12/1966 Buell
3,379,264 A 4/1968 Cox
3,429,390 A 2/1969 Bennett
3,493,165 A 2/1970 Schonfield
3,583,504 A 6/1971 Aalund
3,732,143 A * 5/1973 Joosse ..... 175/6
3,764,493 A 10/1973 Rosar
3,807,512 A * 4/1974 Pogonowski et al. ..... 175/106
3,815,692 A * 6/1974 Varley ..... 175/65
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summers
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,478,296 A * 10/1984 Richman, Jr. ..... 175/92
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,775,017 A * 10/1988 Forrest et al. ..... 175/65
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A * 8/1991 Jurgens ..... 175/246
5,088,568 A * 2/1992 Simuni ..... 175/14
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,978,644 A 11/1999 Sato
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A * 10/2000 Anderson ..... 175/268
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswami
9,629,076 4/2005 Fanuel
6,953,096 B2 10/2005 Gledhill
3,301,339 A1 9/2006 Pennebaker
7,419,016 B2 * 9/2008 Hall et al. ..... 175/399
7,424,922 B2 * 9/2008 Hall et al. ..... 175/317
7,426,968 B2 * 9/2008 Hall et al. ..... 175/40
7,484,576 B2 * 2/2009 Hall et al. ..... 175/73
7,503,405 B2 * 3/2009 Hall et al. ..... 175/61
7,549,489 B2 * 6/2009 Hall et al. ..... 175/385
7,559,379 B2 * 7/2009 Hall et al. ..... 175/61
7,600,586 B2 * 10/2009 Hall et al. ..... 175/61
2003/0212621 A1 11/2003 Poulter et al.
2004/0238221 A1 12/2004 Runia
2004/0256155 A1 12/2004 Kriesels

* cited by examiner

LEAD THE BIT ROTARY STEERABLE SYSTEM

CROSS REFERENCE TO RELATED APPLICATIONS

This Patent Application is a continuation-in-part of U.S. patent application Ser. No. 12/362,661 filed Jan. 30, 2009, which is a continuation-in-part of U.S. patent application Ser. No. 11/837,321 filed Aug. 10, 2007, now U.S. Pat. No. 7,559,379, which is a continuation-in-part of U.S. patent application Ser. No. 11/750,700, filed May 18, 2007 now U.S. Pat. No. 7,549,489, which is a continuation-in-part of U.S. patent application Ser. No. 11/737,034, filed Apr. 18, 2007 now U.S. Pat. No. 7,503,405, which is a continuation-in-part of U.S. patent application Ser. No. 11/686,638, filed Mar. 15, 2007, now U.S. Pat. No. 7,424,922, which is a continuation-in-part of U.S. patent application Ser. No. 11/680,997, filed Mar. 1, 2007, now U.S. Pat. No. 7,419,016, which is a continuation-in-part of U.S. patent application Ser. No. 11/673,872, filed Feb. 12, 2007, now U.S. Pat. No. 7,484,576, which is a continuation-in-part of U.S. patent application Ser. No. 11/611,310, filed Dec. 15, 2006 now U.S. Pat. No. 7,600,586, which is a continuation-in-part of U.S. patent application Ser. No. 11/278,935, filed Apr. 6, 2006, now U.S. Pat. No. 7,426,968, which is a continuation-in-part of U.S. patent application Ser. No. 11/277,394, now U.S. Pat. No. 7,398,837, filed Mar. 23, 2006, which is a continuation-in-part of U.S. patent application Ser. No. 11/277,380, filed Mar. 24, 2006 now U.S. Pat. No. 7,337,858, which is a continuation-in-part of U.S. patent application Ser. No. 11/306,976, filed Jan. 18, 2006 now U.S. Pat. No. 7,360,610, which is a continuation-in-part of U.S. patent application Ser. No. 11/306,307, filed Dec. 22, 2005 now U.S. Pat. No. 7,225,886, which is a continuation-in-part of U.S. patent application Ser. No. 11/306,022, filed Dec. 14, 2005 now U.S. Pat. No. 7,198,119, which is a continuation-in-part of U.S. patent application Ser. No. 11/164,391, filed Nov. 21, 2005 now U.S. Pat. No. 7,270,196.

BACKGROUND OF THE INVENTION

This invention relates to the field of directional drilling tools. The prior art includes several methods for steering a tool string. A bent sub system is generally depicted in FIG. 1*a*. In this embodiment, the drill string comprises a bent sub 2050 above the drill bit 2051. A hydraulic motor housed within the drill string component's bore rotates the drill bit below the bent sub 2050. As drilling mud is passed through the drill string the motor turns in response to the flow and rotates a portion 2052 of the drill string below the bent sub. The portion 2053 above the bent sub does not rotate, but slides through the hole as the drill bit advances into the earth. The bent sub directs the drill strings trajectory in relation to the bend's angle.

A push-the-bit system is generally depicted in FIG. 1*b*. In this embodiment, an extendable pad 2150 is located above the drill bit 2051. Typically, the drill bit's outer surface has multiple pads that are timed to extend at the same azimuthal position with respect to the well bore while the drill string rotates. Each pad extension pushes the drill bit off course along the desired trajectory.

Variations of these systems are disclosed in the following prior art documents. U.S. Pat. No. 5,529,133 to Eddison, which is hereby incorporated by reference for all that it contains, discloses a steerable rotary drilling tool that includes a drill bit mounted on the lower end of a housing by a drive shaft having an articulative coupling that allows the bit's rotation axis to be inclined relative to the rotation axis of the housing, an eccentric weight in the housing that maintains the bit axis pointed in only one direction in space as the bit is turned by the housing, and a clutch system that allows such direction to be changed downhole. A measuring-while-drilling tool is included to allow the progress of the drilling to be monitored at the surface, and to allow changing the bit axis or toolface by a selected amount.

U.S. Pat. No. 5,078,650 to Foote which is herein incorporated by reference for all that it contains discloses a universal joint arrangement that includes a first adapter having two projecting support formations; a drive plate having a first pair of matching depressions or pockets is seated with these depressions on the projecting support formations of the first adapter and the drive plate has a second pair of pockets for the projecting support formations of a respective second adapter.

U.S. Pat. No. 7,188,685 to Downton which is herein incorporated by reference for all that it contains discloses a bottom hole assembly that is rotatably adapted for drilling directional boreholes into an earthen formation. It has an upper stabilizer mounted to a collar, and a rotary steerable system. The rotary steerable system has an upper section connected to the collar, a steering section, and a drill bit arranged for drilling the borehole attached to the steering section. The steering section is joined at a swivel with the upper section. The steering section is actively tilted about the swivel. A lower stabilizer is mounted upon the steering section such that the swivel is intermediate the drill bit and the lower stabilizer.

BRIEF SUMMARY OF THE INVENTION

In one aspect of the invention a tool string steerable system has a drill bit body with a working face. An indenter protrudes from the working face, and the indenter is rotational fixed to a tool string component above the drill bit body. The indenter is rotationally isolated from the drill bit body.

The drill bit body may be attached to a downhole motor housed within the tool string, and the indenter may be rigidly attached to the motor. In some embodiments, the motor may be a hydraulic motor, an electric motor, a positive displacement motor, or a combination thereof Embodiments with a positive displacement motor may comprise a central stator and an outer rotor that moves around the central stator. A rotary bearing may be disposed between an inner surface of the tool string's bore wall and the outer surface of the outer rotor. At least one end of the outer rotor may comprise a thrust bearing. In some embodiments, the outer rotor is rotationally fixed to the drill bit body. A collar may be disposed within at least a portion of the tool string and rigidly connected at a first end to the drill bit body and to the outer rotor at a second end.

A drive shaft connected to the indenter may run through the motor. A universal joint or a constant velocity joint may be used to keep the indenter centered despite the nutating motion caused by the positive displacement motor.

The indenter may comprise an asymmetric distal end. In some embodiments, the distal end comprises a planar region that forms an angle of 35 to 55 degrees with the drill bit's axis of rotation. The indenter may be coaxial with the drill bit's rotational axis.

In some embodiments, the drill bit body may be rigidly attached to a turbine. Also, the system may include an orientation package that determines the indenter's orientation relative to the drill bit body.

In another aspect of the invention a tool string steerable system has a drill bit body with a working face and a shank. The drill bit body is rotationally isolated from the tool string. An indenter protrudes from the working face, and the indenter is rotational fixed to a tool string. The indenter is rotationally isolated from the drill bit body.

DETAILED DESCRIPTION OF THE INVENTION AND THE PREFERRED EMBODIMENT

Figure 1:
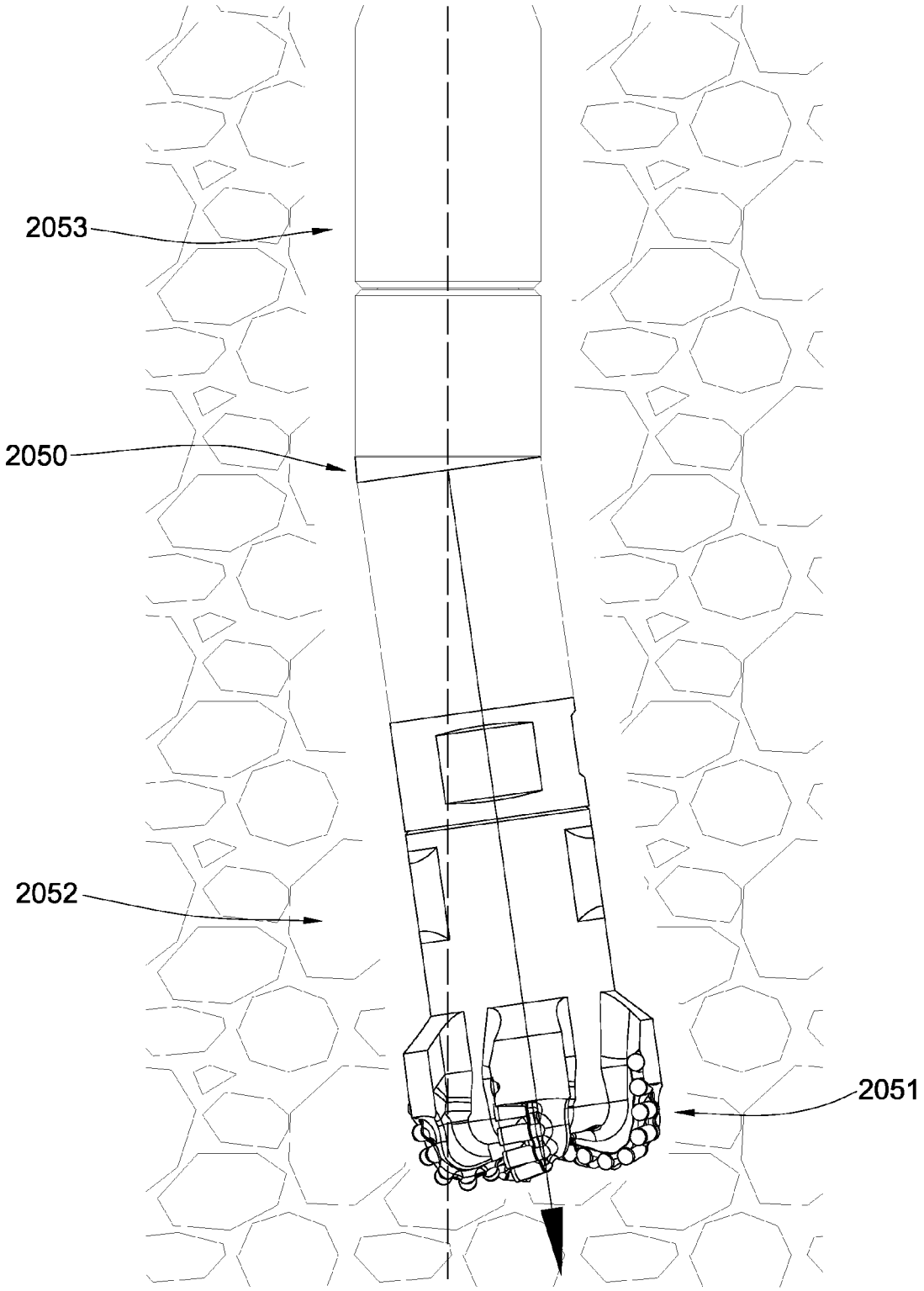
Fig. 1 PRIOR ART
FIG. 1 is a cross sectional diagram of an embodiment of a bent sub steering system.
Figure 2:
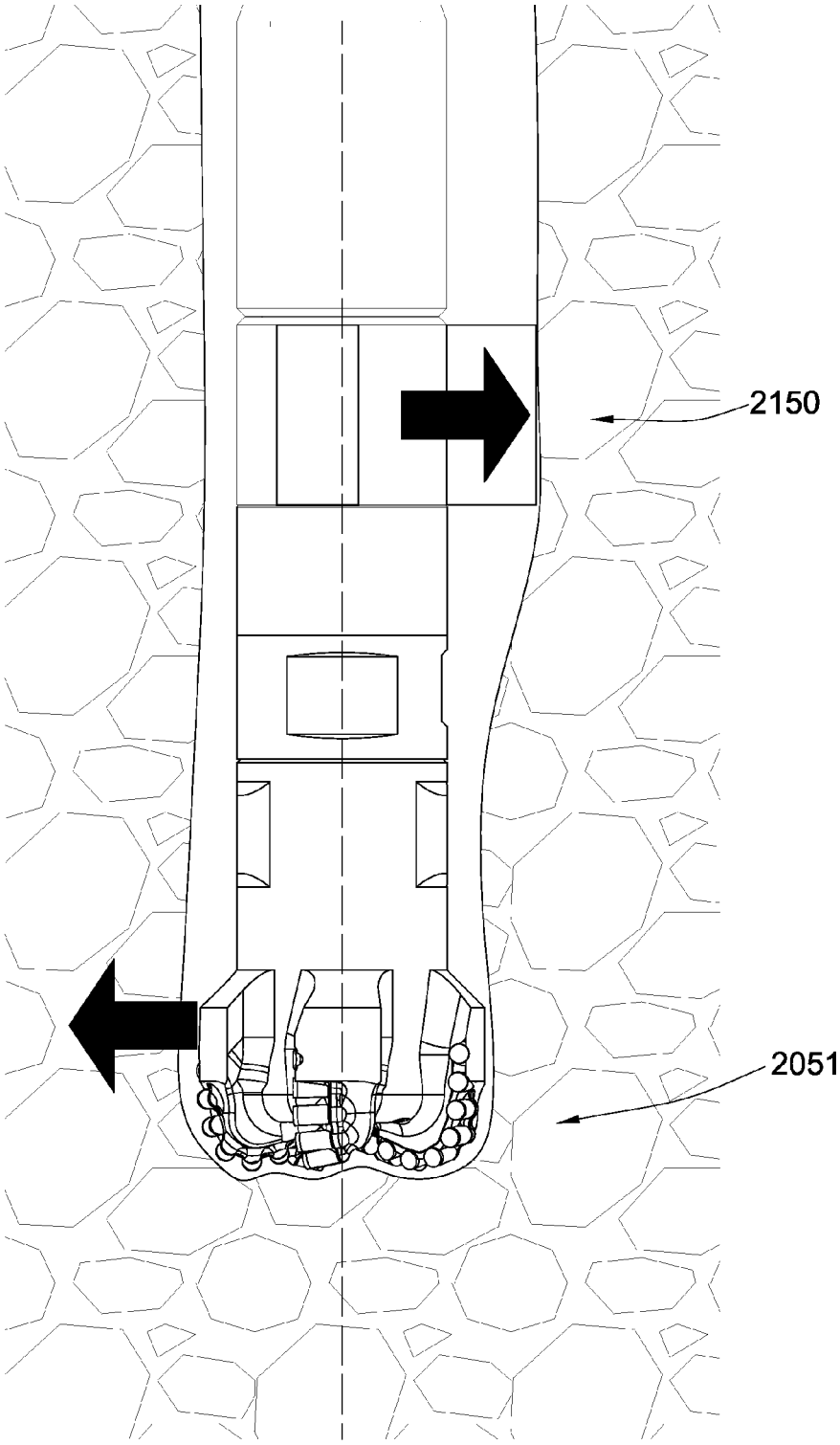
Fig. 2 PRIOR ART
FIG. 2 is a cross sectional diagram of an embodiment of a push-the-bit steering system.
Figure 3:
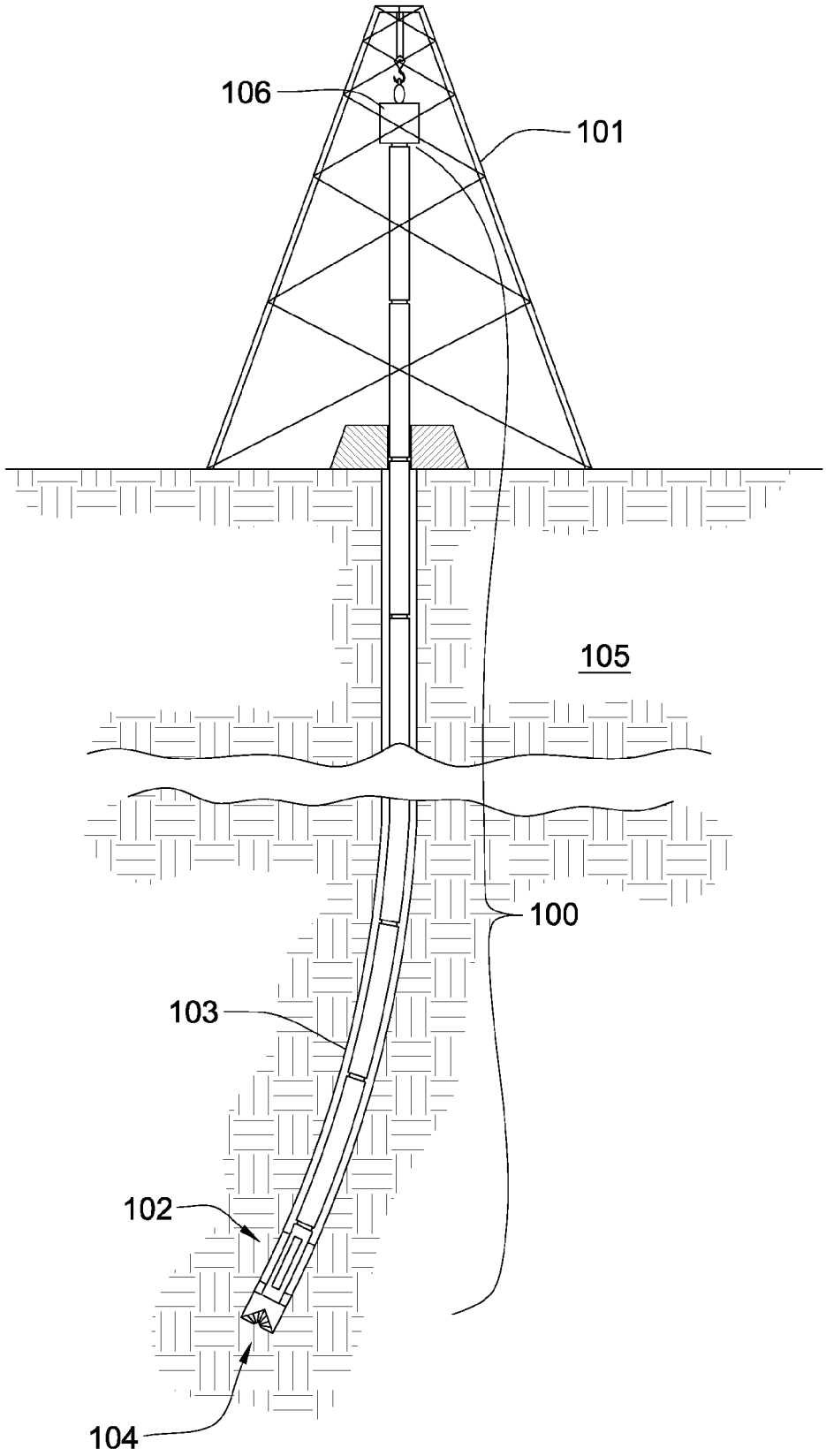
FIG. 3 is a cross sectional diagram of an embodiment of a tool string.

FIG. 3 discloses a tool string 100 suspended by a derrick 101. A bottom-hole assembly 102 is located at the bottom of a wellbore 103 and comprises a drill bit body 104. As the drill bit body 104 rotates, the tool string 100 advances farther into the earth. The drill bit 100 may cut through different subterranean formations 105 along the tool string's trajectory. A steering system may be adapted to lead the drill bit along the trajectory and/or avoid potentially problematic portions of the formation The bottom hole assembly 102 and/or tool string components may comprise data acquisition devices, which may send data to the surface via a transmission system. A data swivel 106 may acquire the data from the rotating tool string and send the data to the surface equipment over stationary data cables. Further, the surface equipment may send data and/or power to the downhole devices. U.S. Pat. No. 6,670,880, which is herein incorporated by reference for all that it contains, discloses a telemetry system that may be compatible with the present invention. However, other telemetry forms may also be compatible such as systems that include mud pulse systems, electromagnetic waves, radio waves, optical signals, and/or short hop. In some embodiments, no telemetry system is incorporated into the tool string.

Figure 4:
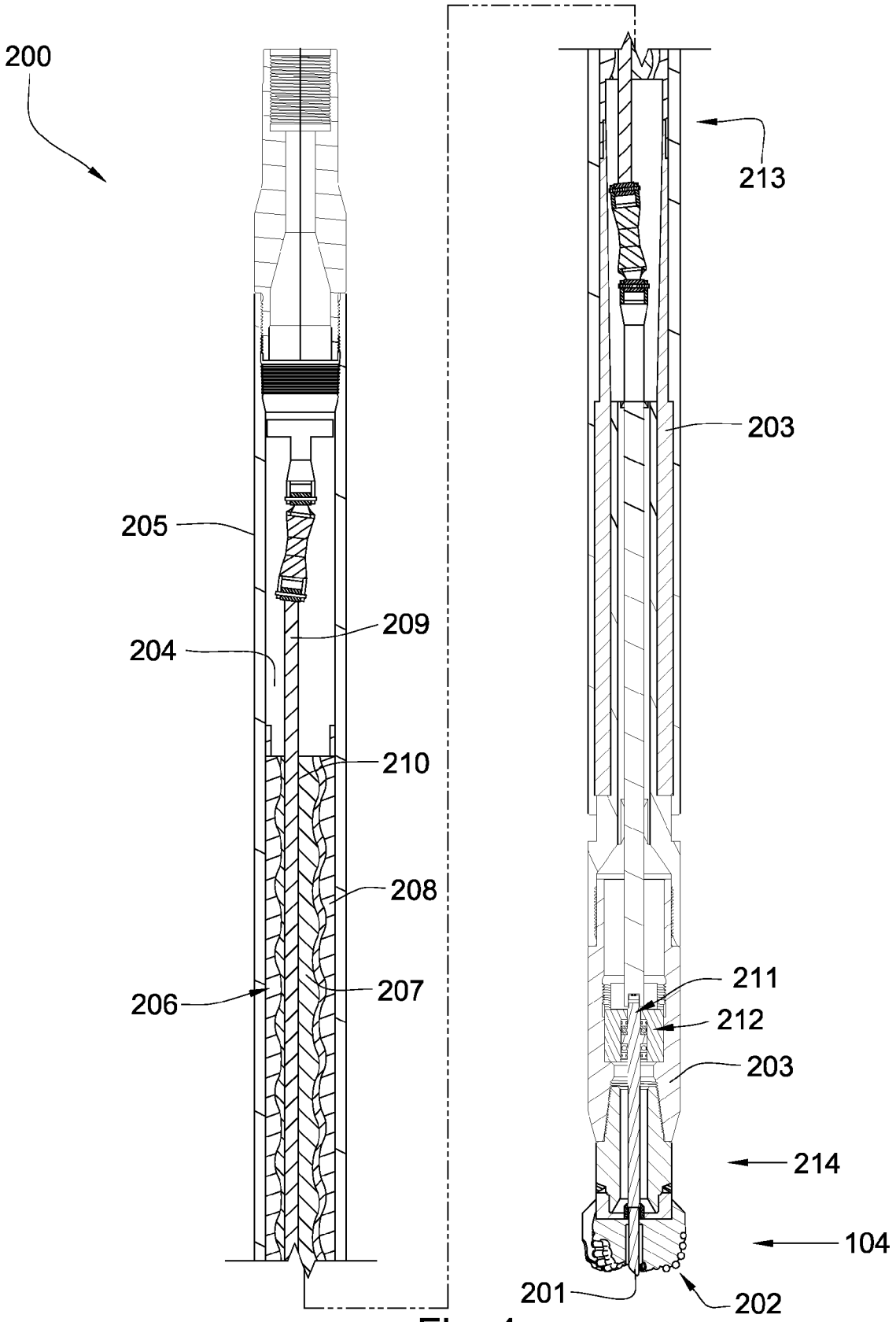
FIG. 4 is a cross sectional diagram of an embodiment of a steering system.

FIG. 4 discloses a steering system 200 incorporating an indenter 201 protruding beyond the drill nit's working face 202. The indenter 201 is rotationally isolated from the drill bit body 104 and rotationally fixed to a tool string component 205. Preferably, the indenter 201 is coaxial with the drill bit's axis of rotation. A motor 206, preferably a positive displacement motor, is also disposed and supported within the bore 204. The motor 206, as shown in FIG. 4, has a central stator 207, which is rigidly connected to the tool string, and an outer rotor 208, which is rigidly connected to the drill bit body. A collar 203 that is partially disposed within a portion of the tool string's bore 204 may connect the outer rotor 208 to the drill bit body 104. Preferably, a drive shaft 209 from the indenter 201 runs through an aperture 210 in the motor 206 to rigidly attach the indenter to a tool string component 205.

The drive shaft may be connected to the indenter's proximal end 211. Thrust and rotary bearings 212 are disposed within the bore 204 to help stabilize the indenter. A portion of the collar 203 is connected to the outer rotor at one end 213 and threaded to the drill bit at the other end 214.

Figure 5:
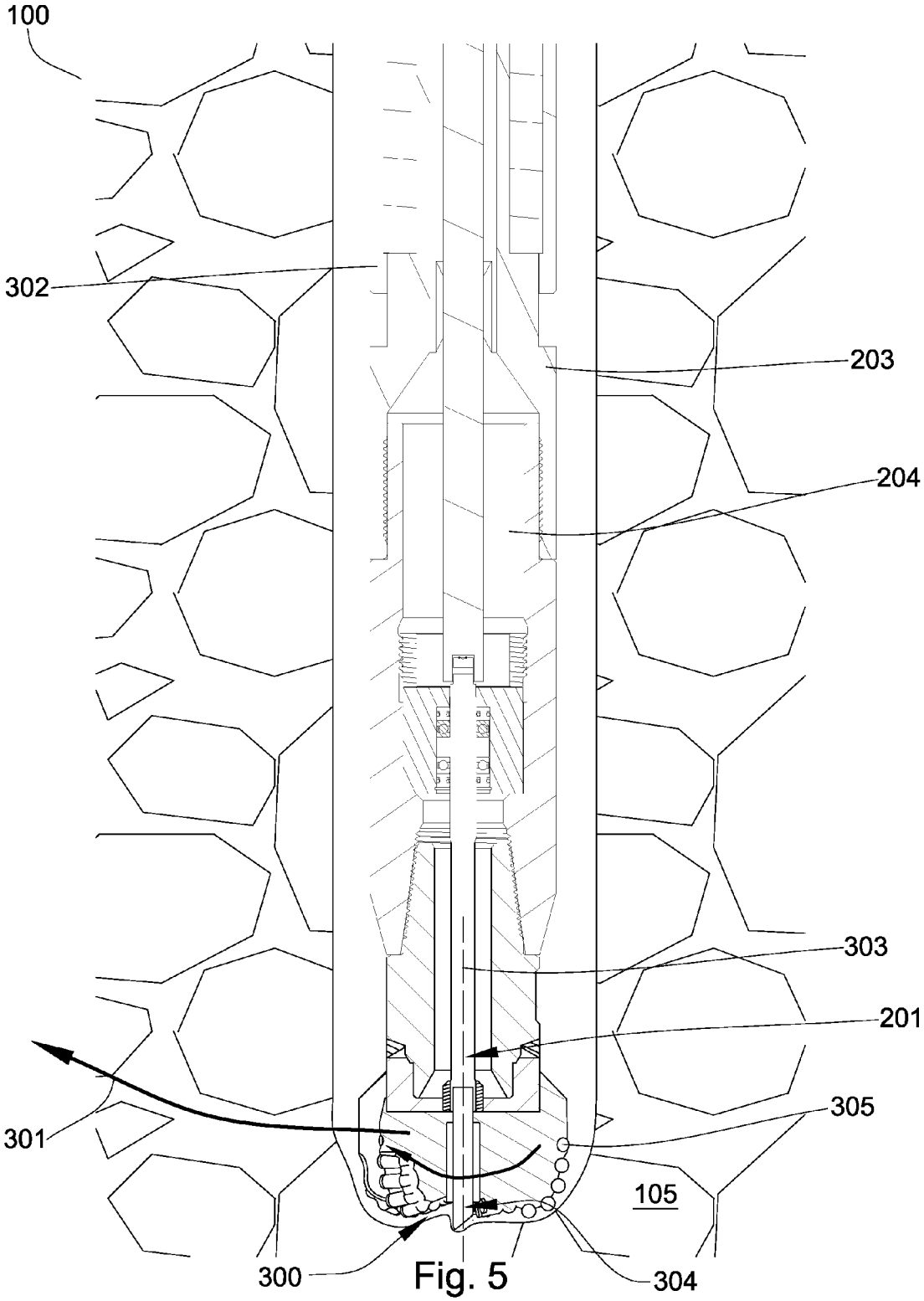
FIG. 5 is a cross sectional diagram of an embodiment of a drill bit with an indenter.

FIG. 5 discloses the indenter 201 with an asymmetric distal end 300 that is adapted to urge the drill bit body 104 along a predetermined azimuth 301. When steering is desired, the tool string 100 is rotated until the indenter 201 is oriented at the desired deviating azimuth 301. Drilling mud is pump through the bore 204 so the motor rotates the drill bit around the indenter. Since the indenter is fixed to the tool string, the indenter remains substantially stationary with respect to the formation 105 while building angle. As the drill bit advances deeper into the formation, the bit is led along the azimuth's direction by the indenter, and the rotationally stationary portion 302 of the tool string slides along behind the rotating drill bit body 104 and collar 203.

When a straight trajectory is desired, the tool string is rotated, preferably by a kelly at the surface or by a top hole drive. Rotating the tool string rotates the indenter, so the asymmetric distal end can not urge the drill bit in any particular direction.

The indenter is preferably made of a cemented metal carbide with adequate hardness and toughness for harsh drilling environments. In some embodiments, the indenter's distal end is enhanced with sintered polycrystalline diamond, cubic boron nitride, or another suitable material harder than carbide. Asymmetries of the indenter's distal end that may be compatible with the present invention are disclosed in U.S. Pat. Nos. 7,506,701 and 7,360,610 and U.S. Patent Publication Nos. 2007/0272443, 20080142264, 2009/0133936, which are all incorporated by reference for all that they contain. In some embodiments, the distal end comprises a planar region 304 that forms a 35 to 55 degrees angle with the drill bit's rotational axis 303.

The present figure discloses a rotary drag bit with conventional cylindrically shaped diamond enhanced cutters 305. In some embodiments, the cutters may be chisel or conical shape. Percussion bits, roller cone bits, horizontal drill bits, and water well bits may be adapted to include the steering system.

The indenter may off load some weight-on-bit (WOB) and contribute to breaking the formation in compression. The distal end's build rate may be affected by the formations' hardness, the amount of WOB loaded to the indenter, and the amount of WOB loaded to the bit's working face. In some embodiments, the indenter is capable of moving vertically with respect to the working face to adjust the amount of WOB loaded to the indenter. In some embodiments, a hammering mechanism may also be adapted to induce a vibration through the indenter to degrade the formation or induce an acoustic signal into the formation.

Figure 6:
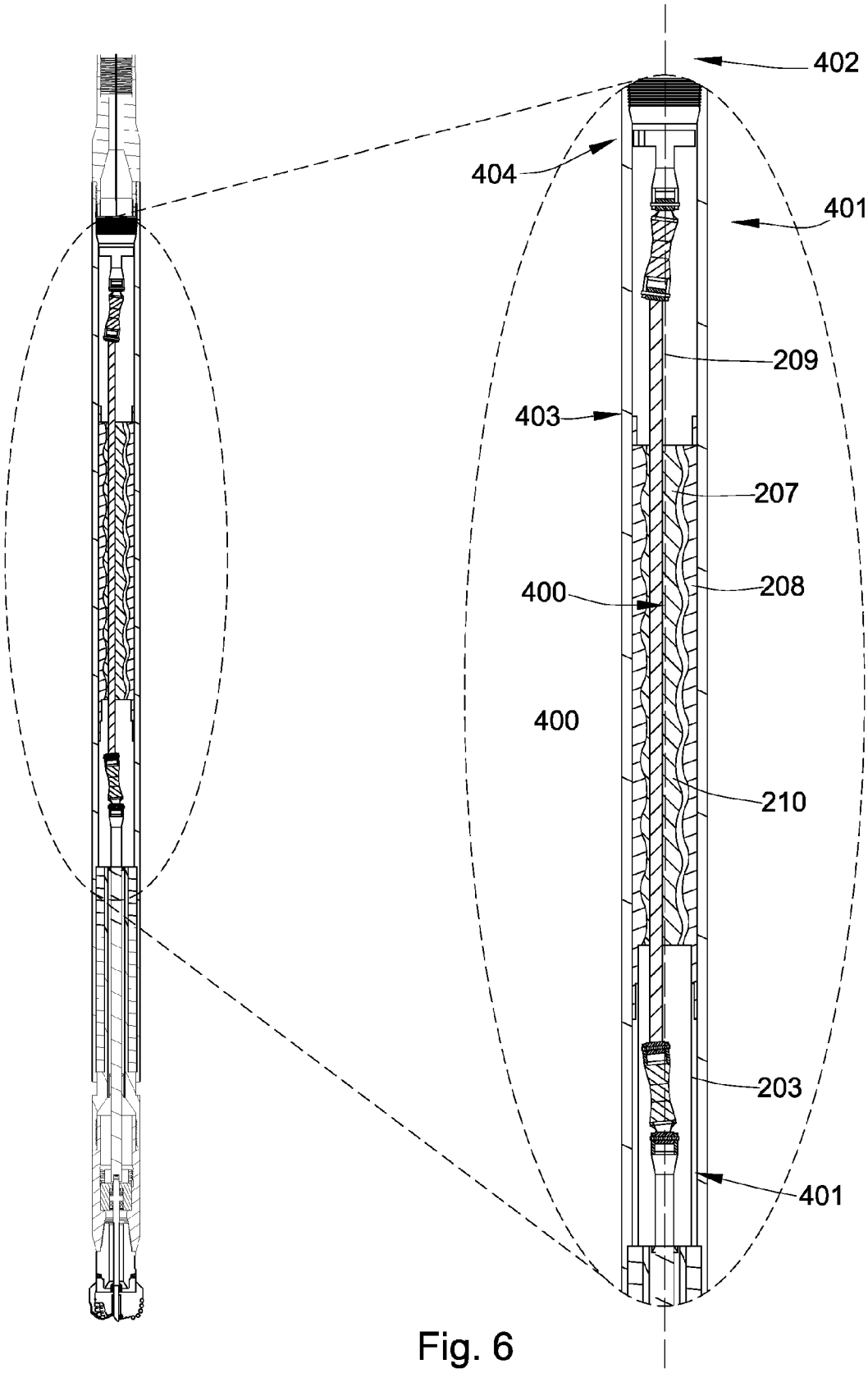
FIG. 6 is a cross sectional diagram of an embodiment of a motor.

FIG. 6 discloses a positive displacement motor 400 with the central stator 207 and outer rotor 208. The drive shaft 209 runs through an aperture 210 in the central stator. The central stator may move laterally due to the motor's nutating motion. Joints 401, constant velocity or universal joints, may be used to align the drive shaft with the tool string's central axis 402. The joints 401 may be incorporated in the shaft 209 both above and below the motor. A thrust bearing 403 may be positioned above and below the outer rotor to account for WOB and its associated reaction forces.

The drive shaft's rigid connection to the tool string's bore wall may include threading, welding, bonding, or keying them together. Fluid bypass ports 404 are preferably incorporated in the connection so drilling mud can pass through.

In some embodiments, no joints (constant velocity or universal) are necessary because the central stator is sufficiently rigidly connected to the downhole pipe and all of the movement takes place in the rotor. In some embodiments, the central stator moves laterally from the action of the positive displacement motor, but remains rotational fixed to the tool string.

Figure 7:
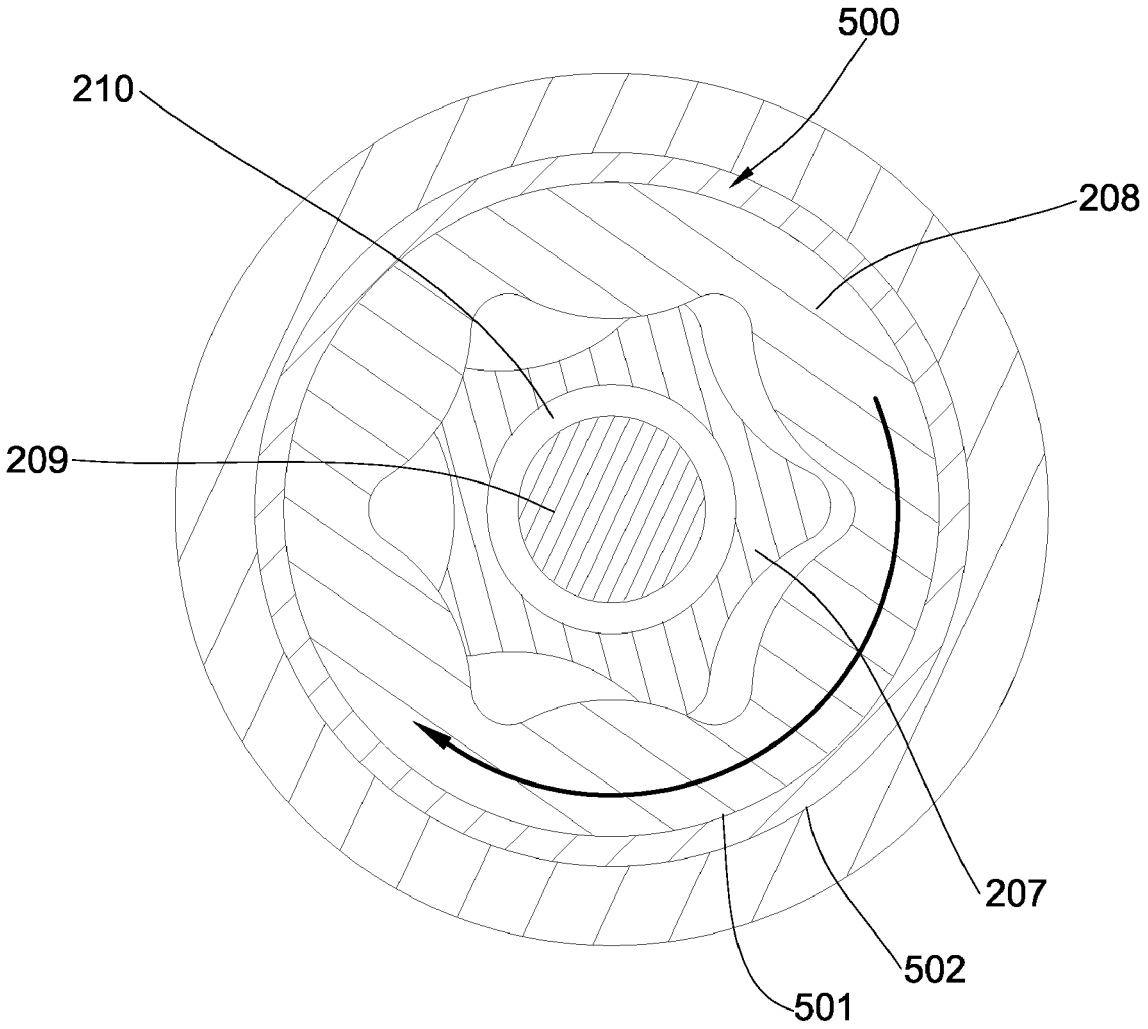
FIG. 7 is a cross sectional diagram of an embodiment of a motor.

FIG. 7 discloses a portion of the driveshaft 209 disposed within an aperture 210 formed in the central stator 207. A bearing 500 is positioned between the rotor's outer surface 501 and bore wall's inner surface 502. The bearing may be a roller bearing, thrust bearing, ball bearing, tapered bearing, rotary bearing or combinations thereof. In some embodiments, the rotor's bearing is sealed off to isolate it from the drilling mud. Oil, grease, or other lubricant may be sealed within a compartment containing the bearing. In other embodiments, some drilling mud is allowed to leak through the bearing to lubricate and cool them.

Figure 8:
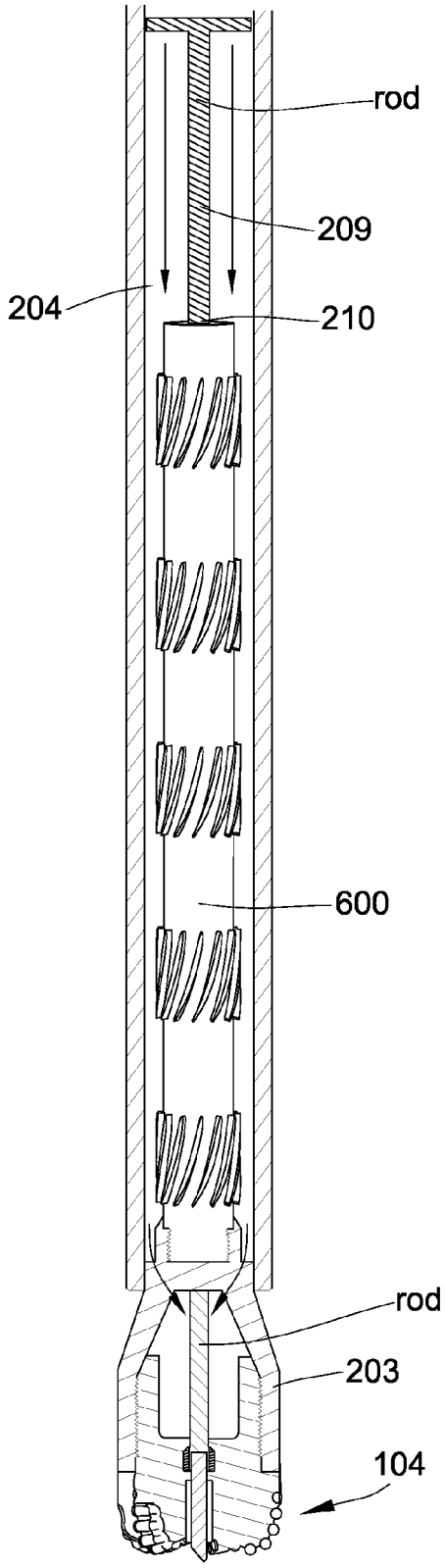
FIG. 8 is a cross sectional diagram of an embodiment of a turbine.

FIG. 8 discloses a mud driven turbine 600 disposed within the tool string's bore 204. The turbine 600 is rigidly connected to the drill bit body 104 through a collar 203. The indenter's drive shaft 209 also runs through an aperture 210 at the turbine's center. Fluid bypasses are incorporated in the bottom of the turbine 600 or the collar 203.

Figure 9:
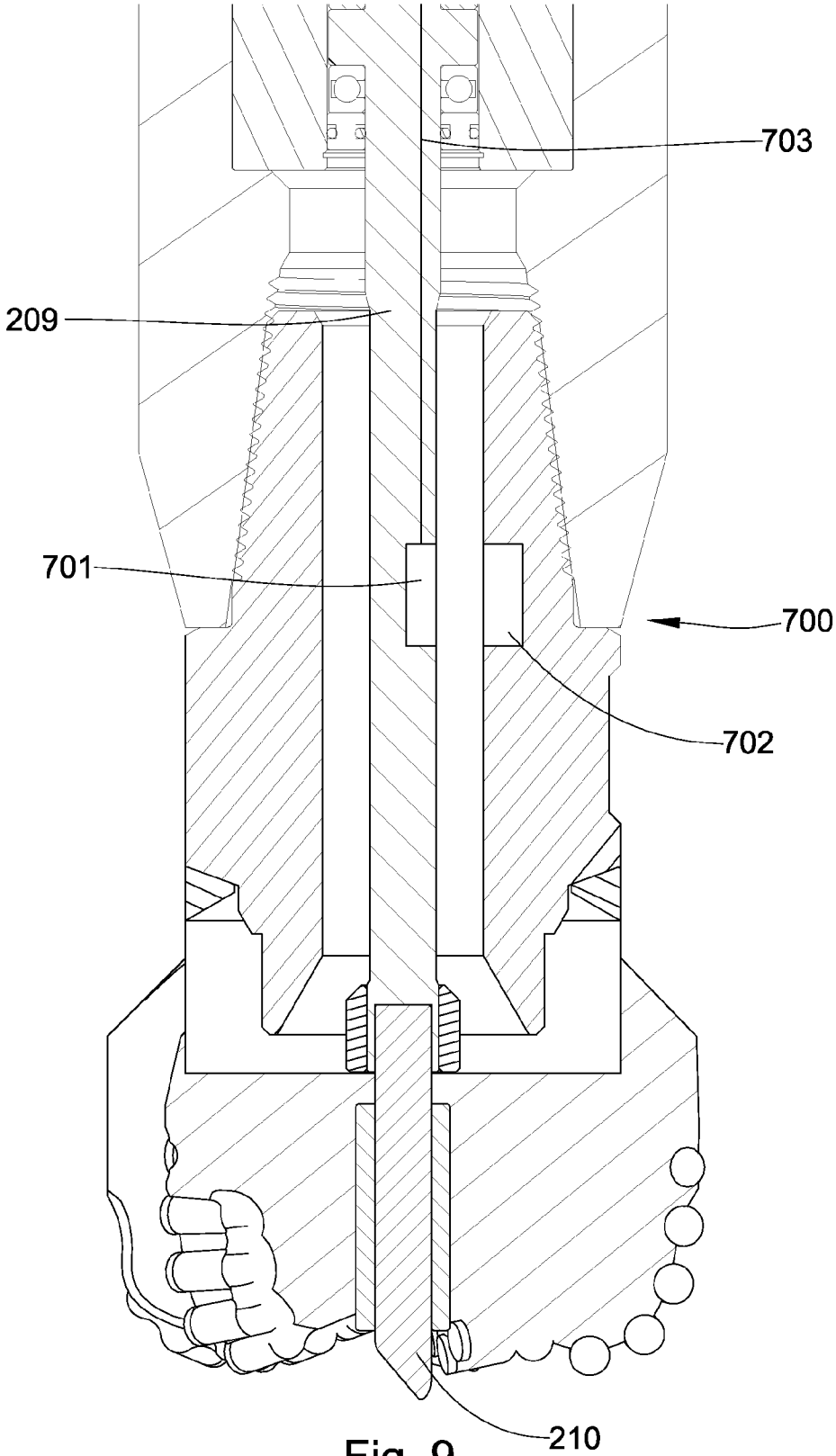
FIG. 9 is a cross sectional diagram of an embodiment of a drill bit with an indenter.

FIG. 9 discloses an orientation package 700 disposed within the drill bit body 104 for determining the orientation and/or azimuth of the indenter 201 with respect to the drill bit body 104. At least one magnetic sensor 701 may be associated with the drive shaft 209 and/or indenter 201, and a magnetic source 702 may be disposed within the drill bit body 104. The sensor 701 may sense its position with respect to the magnetic source 702 allowing the orientation package to determine its azimuth. In some embodiments, a plurality of sensors and sources may be used for finer accuracy. A data transmission path 703, such as a coaxial cable may be used to transmit the orientation data to a telemetry system, such as wired pipe systems, mud pulse systems, electromagnetic systems, optical systems, and/or acoustic systems. In some embodiments, the source may be in the indenter or driveshaft, and the sensors are incorporated in the drill bit body.

In some embodiments, a gyroscope, magnetometer for sensing the earth's magnetic field, and/or accelerometers may be used to determine the relative orientations of the drill bit body and the indenter.

Whereas the present invention has been described in particular relation to the drawings attached hereto, it should be understood that other and further modifications apart from those shown or suggested herein, may be made within the scope and spirit of the present invention.

What is claimed is:

1. A tool string steerable system, comprising:

a drill bit body with a working face;

an indenter protruding from the working face; and the indenter is rotational fixed to a tool string component above the drill bit body, and the indenter is rotationally isolated from the drill bit body.

2. The system of claim 1, wherein the drill bit body is attached to a downhole motor housed within the tool string.

3. The system of claim 2, wherein the indenter is rigidly connected to the tool string above the motor.

4. The system of claim 2, wherein a drive shaft connected to the indenter runs through the motor.

5. The system of claim 2, wherein the motor is a positive displacement motor.

6. The system of claim 5, wherein the positive displacement motor comprises a central stator and an outer rotor that moves around the central stator.

7. The system of claim 6, wherein a rotary bearing is disposed between an inner surface of the tool string's bore wall and the outer surface of the outer rotor.

8. The system of claim 6, wherein at least one end of the outer rotor comprises a thrust bearing.

9. The system of claim 5, wherein a collar disposed within at least a portion of the tool string is rigidly connected on one end to the drill bit body and rigidly connected to the outer rotor at another end.

10. The system of claim 5, wherein the outer rotor is rotationally fixed to the drill bit body.

11. The system of claim 2, wherein the drive shaft incorporates at least one of a universal joint or a constant velocity joint.

12. The system of claim 1, wherein the indenter comprises an asymmetric distal end.

13. The system of claim 12, wherein the distal end of the indenter comprises a planar region that forms an angle of 35 to 55 degrees with an axis of rotation of the tool string.

14. The system of claim 1, wherein the drill bit body is attached to a turbine housed within the tool string.

15. The system of claim 1, wherein the indenter is coaxial with a rotational axis of the drill bit.

16. The system of claim 1, wherein the system further includes an orientation package that determines the orientation of the indenter relative to the drill bit body.

17. A tool string steerable system, comprising:

a drill bit body with a working face;

the drill bit body being rotationally isolated from the tool string;

an indenter protruding from the working face; and the indenter is rotational fixed to a tool string component, and the indenter is rotationally isolated from the drill bit body.

* * * * *